United States Patent [19]

Develay et al.

[11] 4,069,072

[45] Jan. 17, 1978

[54] ALUMINUM ALLOY

[75] Inventors: Roger Develay, Seyssinet Pariset; Jean Coupry, Courblerie, both of France

[73] Assignee: Pechiney Ugine Kuhlmann, Lyon, France

[21] Appl. No.: 710,413

[22] Filed: Aug. 2, 1976

Related U.S. Application Data

[63] Continuation-in-part of Ser. No. 479,766, June 17, 1974, abandoned.

[30] Foreign Application Priority Data

June 20, 1973 France ..... 73 22388

[51] Int. Cl.$^2$ ..... C22C 21/10

[52] U.S. Cl. ..... 148/32; 75/140; 75/141; 148/2; 148/11.5 A; 148/12.7 A; 148/32.5; 148/159

[58] Field of Search ..... 75/141, 140; 148/32, 148/32.5, 11.5 A, 12.7 A, 2, 159

[56] References Cited

U.S. PATENT DOCUMENTS

| | | | |
|---|---|---|---|
| 3,198,676 | 8/1965 | Sprowls et al. | 75/141 |
| 3,454,435 | 7/1969 | Jacobs | 148/12.7 A |
| 3,598,577 | 8/1971 | Stonebrook | 75/141 |

*Primary Examiner*—R. Dean

*Attorney, Agent, or Firm*—McDougall, Hersh & Scott

[57] ABSTRACT

Wrought aluminum alloy containing:

Zn 6.5 to 10%
Cu 4.5 to 7%
Mg 0.1 to 1%
Mn 0.01 to 0.5%
Ti 0.01 to 0.3%

The alloy is applicable to the manufacture of forged or rolled pieces.

3 Claims, No Drawings

ALUMINUM ALLOY

This is a continuation-in-part of our copending application Ser. No. 479,766, filed June 17, 1974, and entitled "Aluminum Alloy", abandoned.

This invention relates to wrought alloys based on aluminum.

Modern industrial requirements, in particular in the field of aviation and the automobile, cause any improvement in the ratio of mechanical resistance to specific gravity, no matter how slight, to have important consequences either on the safety or on the performance.

The alloys according to the invention provide an improvement, compared with other known aluminum alloys of the same type, in the yield strength and ultimate strength without at the same time reducing the elongation.

High performance alloys containing, by weight, 3% to 6% of copper, 2 to 5% of zinc, 0.2 to 1.5% of magnesium, 0.2 to 0.6% of manganese and 0.005 to 0.4% of titanium (French Patent No. 1,599,739) or having similar compositions (French Patent No. 1,496,950) have already been proposed.

These alloys have been described as being particularly suitable for manufacturing molded pieces.

In the course of researches which led to the present invention, it was discovered quite unexpectedly that if one varies the zinc content while keeping the proportion of other elements within the limits indicated above, the mechanical properties, which undergo little modification so long as the zinc content is below 4.5% by weight, are greatly improved at 6.5% up to a zinc content of about 10% and that the alloy is then very suitable for forming by hot working. Above 10% by weight, difficulties arise in the casting of the billets, which may result in faults in the metal.

The alloys according to the invention have the following contents by weight:

| | | |
|---|---|---|
| Zn | 6.5 to 10% | preferably 6.5 to 8% |
| Cu | 4.5 to 7% | preferably 5.5 to 6.5% |
| Mg | 0.1 to 1% | preferably 0.25 to 0.5% |
| Mn | 0.01 to 0.50% | preferably 0.20 to 0.30% |
| Ti | 0.01 to 0.30% | preferably 0.10 to 0.20% |

These alloys may also contain the following additional elements:

| | |
|---|---|
| Fe | up to 1% |
| Ni and Co on condition that $\frac{\text{weight \% of Fe}}{\text{weight \% of (Ni + Co)}} = 1 \pm 0.3$ | |
| Si | up to 0.5% |
| Cd | less than 0.1% |
| Ge | less than 0.75% |
| Zr | less than 0.5% |

-continued

| | |
|---|---|
| Sn | less than 0.5% |
| Sb | less than 0.5% |
| Be | less than 0.1% |

Four alloys A, B, C and D which had the following composition were prepared as examples:

| | A | B | C | D |
|---|---|---|---|---|
| Zn | 0 | 3.0 | 6.5 | 8.0 |
| Cu | 5.95 | 5.95 | 5.95 | 6 |
| Mg | 0.32 | 0.31 | 0.31 | 0.34 |
| Mn | 0.26 | 0.26 | 0.26 | 0.26 |
| Fe | 0.21 | 0.21 | 0.21 | 0.18 |
| Si | 0.18 | 0.18 | 0.18 | 0.19 |
| Ti | 0.10 | 0.10 | 0.10 | 0.09 |

remainder aluminum and the alloys were subjected to the following treatments:

Each of the alloys was cast semicontinuously in the form of a plate measuring 120 × 380 mm in cross-section and then subjected to a relaxation treatment at 400° C, consisting of progressively raising the temperature followed by controlled cooling (duration of the cycle: 18 hours).

The metal was then homogenized at 500° C for 24 hours. After removal of the crust from the surface, the metal was hot rolled from 100 mm to 12 mm, at a rolling temperature of 420° C.

The sheets 12 mm in thickness were heat treated for 4 hours at a temperature of 527°, 520°, 512° and 506° C for the alloys A, B, C and D, respectively, and then quenched in water at 20° C.

Each alloy was divided into two batches. One bath was aged and the other was cold worked by 2% traction for 2 hours after it had been quenched in water and before it was aged.

Samples from both batches, cut from the sheet transversely to the direction of rolling, were then subjected to aging at temperatures between 155° and 185° C for 5 to 40 hours in order to determine the temperature and time which give the best mechanical characteristics.

The following table lists, for each alloy and each batch, the highest characteristics of mechanical traction and the artifical aging required for obtaining these values.

TABLE

| Batch | Amount of Zn added | State | Optimum aging conditions time | Optimum aging conditions temp. | Yield Strength at 0.2% | Ultimate Strength kg/mm² | Elongation break % 5.65 s |
|---|---|---|---|---|---|---|---|
| A1 | 0 % | quenched | 20 h | 175° C | 44 | 50.2 | 9.7 |
| B1 | 3 % | aged | 20 h | 165° C | 45.5 | 51.4 | 9.7 |
| C1 | 6.5% | | 10 h | 165° C | 49.7 | 54.5 | 9.7 |
| D1 | 8.0% | | 10 h | 155° C | 51.5 | 56 | 9.5 |
| A2 | 0 % | quenched cold | 20 h | 175° C | 42.2 | 49.0 | 10.0 |
| B2 | 3.9% | worked | 20 h | 165° C | 42.7 | 49.6 | 7.5 |
| C2 | 6.5% | aged | 10 h | 155° C | 45.9 | 52.5 | 7.8 |
| D2 | 8.0% | | 10 h | 155° C | 46.8 | 53.4 | 7.7 |

It can be seen that an addition of 3% of zinc slightly improves the mechanical characteristics of traction while, with the addition of 6.5 and 8% of zinc, the increase in the yield strength at 0.2% and the ultimate strength are very appreciable whereas the elongations at break are only slightly modified.

It should be noted that the aging treatment which gives the maximum mechanical characteristics varies with the zinc content. When the zinc content is increased, the optimum aging temperature decreases so that it can be seen that the introduction of high zinc contents substantially modifies the kinetics of aging the alloy.

We claim:

1. Wrought aluminum based alloy consisting essentially of:

| | |
|---|---|
| Zn | 6.5 to 10% by weight |
| Cu | 4.5 to 7% by weight |
| Mg | 0.1 to 1% by weight |
| Mn | 0.01 to 0.5% by weight |
| Ti | 0.01 to 0.3% by weight |
| Fe | up to 1% by weight |
| Ni and Co | on condition that $\frac{Fe}{Ni + Co} = 1 \pm 0.3\%$ by weight |
| Si | less than 0.5% by weight |
| Zr | less than 0.5% by weight |
| Sn | less than 0.5% by weight |

-continued

| | |
|---|---|
| Sb | less than 0.5% by weight |
| Cd | less than 0.1% by weight |
| Be | less than 0.1% by weight |
| Ge | less than 0.75% by weight |

Remainder aluminum plus impurities.

2. A wrought alloy as claimed in claim 1 in which the essential alloying elements are present in the amounts of

| | |
|---|---|
| Zn | 6.5 to 8.0% by weight |
| Cu | 5.5 to 6.5% by weight |
| Mg | 0.25 to 0.5% by weight |
| Mn | 0.20 to 0.30% by weight |
| Ti | 0.10 to 0.20% by weight |

3. Forged and rolled elements having the composition of claim 1.

* * * * *